US005094369A

United States Patent [19]

Thompson

[11] Patent Number: 5,094,369

[45] Date of Patent: Mar. 10, 1992

[54] HAT STRECHER WITH RELEASEABLE PAWL AND COLLAR

[76] Inventor: Lester E. Thompson, P.O. Box 1140, Apache Junction, Ariz. 85220

[21] Appl. No.: 530,023

[22] Filed: May 29, 1990

[51] Int. Cl.[5] ..... A42C 1/00

[52] U.S. Cl. ..... 223/25; 223/24; 223/15; 223/84; 223/61; 403/322; 403/325

[58] Field of Search ..... 223/12, 15, 24, 25, 223/61, 84; 2/8, 9, 66; 403/322, 325

[56] References Cited

U.S. PATENT DOCUMENTS

| | | | |
|---|---|---|---|
| 389,014 | 9/1888 | Schellman . | |
| 2,075,626 | 3/1937 | Schlesinger | 223/15 |
| 2,087,158 | 7/1937 | Lindsey | 223/25 |
| 2,107,961 | 2/1938 | Seiler | 223/25 |
| 2,210,797 | 8/1940 | Crim | 403/322 |
| 2,434,184 | 1/1948 | Vlasis | 223/25 |
| 2,439,347 | 4/1948 | Pernini et al. | 223/25 |
| 2,456,054 | 12/1948 | Eberhardt | 403/325 |
| 2,577,167 | 12/1951 | Vlasis | 223/25 |
| 3,450,425 | 6/1969 | Leonhardt | 403/322 |
| 3,459,347 | 8/1969 | Navara | 223/25 |
| 4,673,113 | 6/1987 | Vandewege | 223/15 |

FOREIGN PATENT DOCUMENTS

| | | | |
|---|---|---|---|
| 1220830 | 4/1968 | United Kingdom | 223/96 |

*Primary Examiner*—Andrew M. Falik
*Assistant Examiner*—Bibhu Mohanty
*Attorney, Agent, or Firm*—Cahill, Sutton & Thomas

[57] ABSTRACT

A first arcuate band and a second arcuate band include a threaded rod and a ratchet rod, respectively, secured to one another by an adjustment block to define the operative elements of a hat stretcher. A pair of pawls, lockable in place, extend from the adjustment block to lockingly engage selected ratchet grooves of the ratchet rod and provide coarse adjustment. A threaded bore in the adjustment block threadedly receives the threaded rod to provide fine adjustment. Release and reengagement of the pawls with the selected grooves eliminates the need for readjustment of the hat stretcher between periods of use with a same sized hat.

11 Claims, 1 Drawing Sheet

HAT STRECHER WITH RELEASEABLE PAWL AND COLLAR

BACKGROUND OF THE INVENTION

1. Field of the Invention

This invention relates to hat stretchers and, more particularly, to a hat stretcher having spring loaded lockable arms for coarse adjustment, a threaded shaft for fine adjustment and extended arcuate bands for engaging the hat band.

2. Description of the Prior Art

Hat stretchers have been used for many years to maintain hats in proper shape during storage, drying and cleaning. The most commonly used hat stretchers include a pair of arcuate plates, or bands, with threaded rods interconnected by a turnbuckle or similar structure. Manual rotation of the turnbuckle relocates the arcuate bands toward or away from one another to adjust the hat stretcher to the proper size for the hat to be stretched. This type of hat stretcher is cumbersome to use as it is difficult to hold that hat to be stretched and to hold the hat stretcher in place while manually rotating the turnbuckle to size the hat stretcher. Each time the same hat is to be stretched between periods of use, this rather cumbersome installation and adjustment procedure must be repeated.

Other hat stretching devices have been used which are more properly described as hat expanders or hat blocking devices. Hat expanders incorporate four arcuate expander blocks that cooperate to define an oval configuration. A diametrically opposed pair of the expander blocks are interconnected by a turnbuckle adjustment structure and the other two expander blocks are connected to the diametrically opposed pair with links and springs. Manual rotation of the turnbuckle causes all four of the expander blocks to move toward or away from each other. In addition to the increased complexity and costs of hat expanders, they suffer from the problem of being cumbersome to install and adjust and the cumbersome installation and adjustment must be repeated for each time of use.

SUMMARY OF THE INVENTION

First and second arcuate plates, or bands, are disposed in spaced apart relationship to bear against opposed substantial segments of the hat band in the hat to be stretched. A threaded rod extends normally from the center of the concave surface of the first arcuate band and a ratchet rod extends normally from the center of the concave surface of the second arcuate band in axial alignment with the threaded rod. An adjustment block interconnects the threaded rod and the ratchet rod to provide an adjustment capability. The adjustment block includes a pair of opposed pawls extending toward one another from a pair of resilient arms to engage the ratchet rod at selectable ratchets and a collar slidable along the arms locks the pawls at the selected ratchet position. A pair of springs bias the arms apart from one another to urge release of the pawls from the ratchet rod. A threaded bore in the adjustment block threadedly receives the threaded rod. The selected ratchet position provides a coarse adjustment and the threaded engagement provides a fine adjustment for the spacing between the first and second arcuate bands. To remove the hat stretcher, the arms are unlocked to permit collapse of the hat stretcher. To reinstall the hat stretcher, the ratchet rod is reengaged by the pair of pawls at the previously selected ratchets and locked in place by the collar; further adjustment is unnecessary.

The primary object of the present invention is to provide a hat stretcher having a pair of adjustable opposed extended length arcuate bands for engaging the major length of the headband of a hat.

Another object of the present invention is to provide an easily lockable coarse adjustment for removing and reinserting a hat stretcher of a predetermined size.

Still another object of the present invention is to provide a hat stretcher having a threaded fine adjustment and an incremental lockable coarse adjustment.

Yet another object of the present invention is to provide an opposed pair of arm mounted pawls for engaging ratchets of a ratchet rod extending from one arcuate band of a pair of arcuate bands of a hat stretcher by bringing the arms toward one another and locking them in place.

A further object of the present invention is to provide an adjustment block having a threaded bore for receiving the threaded rod of one arcuate band of a hat stretcher and a pair of arm mounted pawls for selectively engaging a necked down section of a ratchet rod extending from an opposed arcuate band of the hat stretcher.

A still further object of the present invention is to provide a settable adjustment mechanism for a hat stretcher to permit repetitive installation and removal from same sized hats without intervening adjustment.

A yet further object of the present invention is to provide a method for repetitively inserting a hat stretcher into a hat without readjusting the size setting.

These and other objects of the present invention will become apparent to those skilled in the art as a description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
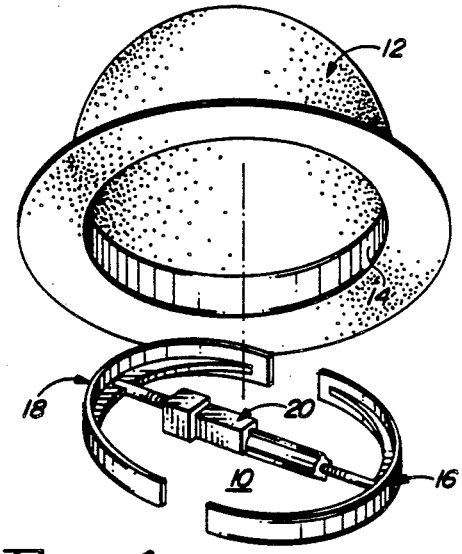
FIG. 1 illustrates a hat stretcher to be inserted within a hat.

A hat stretcher 10 for use with a hat 12 to stretch headband 14 is illustrated in FIG. 1. Aside from stretching the headband, the hat stretcher may also help to block the hat. As shown jointly in FIGS. 1 and 2, hat stretcher 10 includes first and second arcuate bands 16, 18. These bands are joined to one another by an adjustment block 20. The adjustment block receives a threaded rod 22 extending from the mid interior section of first arcuate band 16 and a ratchet rod 24 extending from the mid interior section of second arcuate band 18. The first and second arcuate bands can be repositioned toward and away from one another to accommodate different sized hats 12 by adjusting adjustment block 20.

First and second arcuate bands 16, 18 have curved bands 26, 28 which extend in opposed directions from the mid point represented by the point of attachment of the respective rods. The planes represented by the ends of each of the arcuate bands are close to or parallel with one another; therefore, each of the arcuate bands engage most of one half of the hat headband. The resulting extended length of each of the arcuate bands smoothly and essentially continuously distributes the forces imposed by the hat stretcher and prevents discontinuous deformation of the hat headband. To maintain each of first and second arcuate bands 16, 18 in a predetermined curved configuration, an orthogonally oriented brace (30, 32), crescent shaped in planform, may be secured to respective bands 26, 28.

Figure 2:
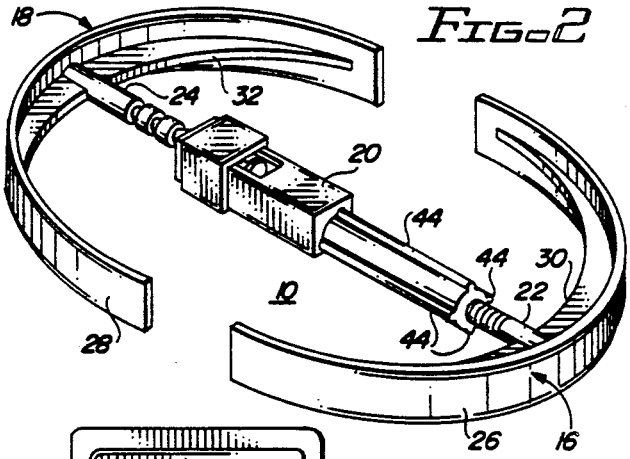
FIG. 2 is an isometric view of the hat stretcher.
Figure 3:
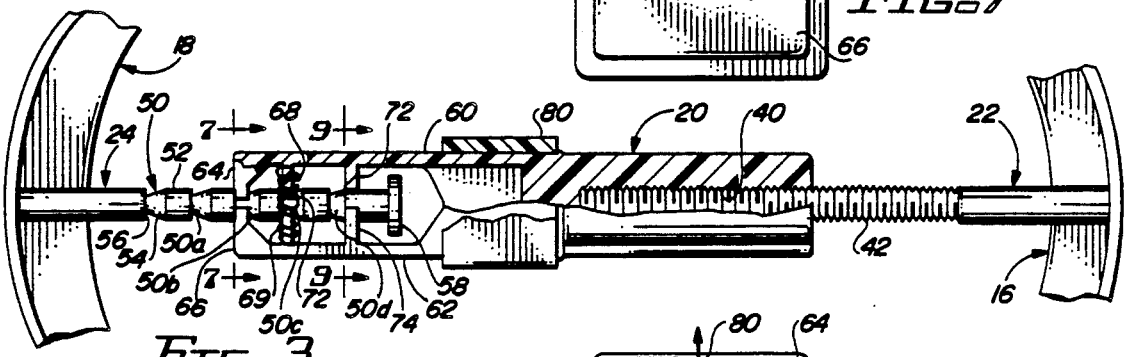
FIG. 3 is a partial cross sectional view of the adjustment mechanism for the hat stretcher.
Figure 4:
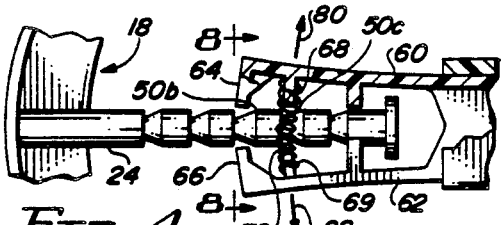
FIG. 4 illustrates release of the coarse adjustment mechanism.

Referring jointly to FIGS. 2 and 3, certain features of the fine and coarse adjustment capability of hat stretcher 10 will be discussed. Adjustment block 20 includes a threaded bore 40 for receiving threaded segment 42 of threaded rod 22. Upon rotation of adjustment block 20 relative to first arcuate band 16, threaded rod 22 will retract into or extend from the adjustment block and reposition the first arcuate band accordingly with respect to the adjustment block. The adjustment block may include a plurality of longitudinally oriented ridges 44 to assist in rotating the adjustment block.

Ratchet rod 24, extending from second arcuate band 18, includes a plurality of ratchet grooves 50 between cylindrical segments 52 and defined by a cammed surface 54 intersecting a radially oriented surface 56. An end flange 58, extending radially past the cylindrical surface of ratchet rod 24 is disposed at the end of the ratchet rod to serve in the manner of a stop. Adjustment block 20 includes a pair of opposed arms 60, 62, which may be strap like, extending in a direction opposed from that of threaded bore 40. A pair of pawls 64, 66 extend toward one another from the ends of arms 60, 62, respectively. Two pairs of prongs 68, 69 and 70, 71 extend toward one another to support springs 73, 75, respectively, in compression. These springs, retained in place by the respective prongs, urge arms 60, 62 apart from one another to release the ratchet rod from pair of pawls 64, 66. A pair of support elements 72, 74 extend toward one another from arms 60, 62. The pair of support elements are displaced along the longitudinal axis of the adjustment block a distance commensurate with the distance between a ratchet groove and a cylindrical segment defined by a pair of ratchet grooves. A collar 80 is longitudinally translatable along arms 60, 62 to permit or inhibit lateral displacement of the arms in opposed directions, depending upon the position of the collar along the adjustment block.

The coarse adjustment feature of hat stretcher 10 will be described with joint reference to FIGS. 4 through 9. To set the initial coarse adjustment, arms 60, 62 are bent apart from one another, as depicted by arrows 80, 82, by urging of springs 72, 73. The resulting opposed movement of the arms will disengage pawls 64, 66 from ratchet groove 50*b*. Second arcuate band 18 may now be pushed towards adjustment block 20 to reduce the distance between the first and second arcuate bands, as depicted by arrow 84. Commensurately, ratchet rod 24 will be forced further into adjustment block 20 between arms 60, 62. Upon incremental translation of ratchet rod 24 commensurate with the distance between two adjacent ratchet grooves, and upon release of arms 60, 62, pair of pawls 64, 66 will be forced into ratchet groove 50. Simultaneously, support elements 72, 74, will be repositioned upon segment 52*b*. To maintain the pair of pawls and the pair of support elements in the position depicted in FIG. 5, collar 80 is translated to the end of arms 60, 62 to prevent relative lateral displacement there between. The inhibited movement of the arms will preclude the pair of pawls from disengaging with the engaged ratchet grooves.

Figure 7:
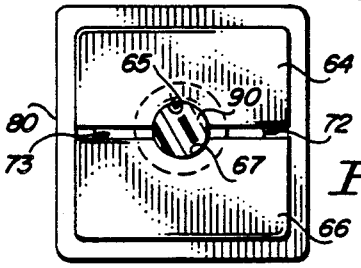
FIG. 7 is an end view taken along lines 7—7, as shown in FIG. 3.
Figure 8:
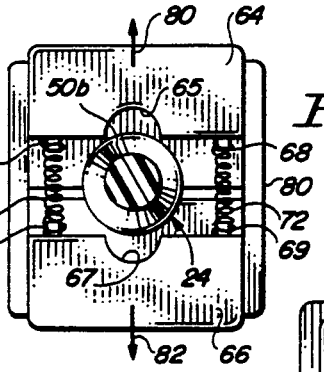
FIG. 8 is an end view taken along lines 8—8, as shown in FIG. 4.
Figure 5:
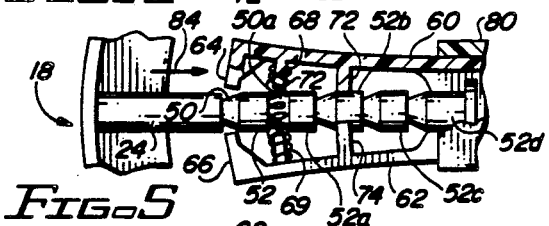
FIG. 5 illustrates adjustment of the coarse adjustment mechanism.
Figure 9:
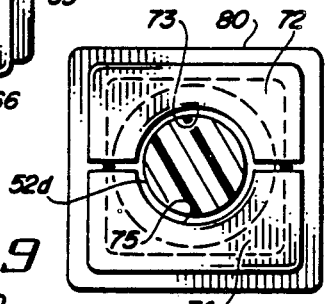
FIG. 9 is a cross sectional view taken along lines 9—9, as shown in FIG. 3.

As particularly shown in FIG. 7, pawl 64 includes a semicircular indentation 65 for receiving a necked down section 90 of ratchet rod 24, which necked down section defines ratchet groove 50*b*. Pawl 66 includes a similar semi circular indentation 67 for the same purpose. FIG. 8 illustrates lateral movement of pawls 64, 66 in response to outward opposed flexing of arms 60, 62 due to the force exerted by prong supported springs 72, 73 to bring about complete disengagement of indentations 65, 67 from any part of ratchet rod 24. Such disengagement permits translation of adjustment block 20 along the ratchet rod without interfering contact between pawls 64, 66 and the ratchet rod.

Figure 6:
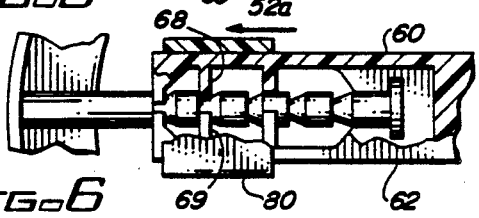
FIG. 6 illustrates locking of the coarse adjustment mechanism.
Figure 10:
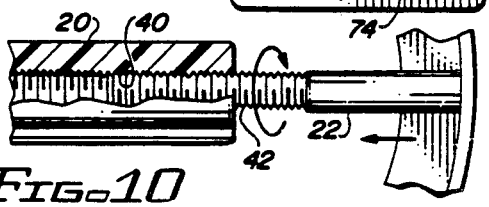
FIG. 10 illustrates operation of the fine adjustment mechanism.

The purpose of support elements 72, 74 is that of contacting one of cylindrical segments 52*b*, 52*c* or 52*d* to provide stability for adjustment block 20 to engage and retain without undue wobble ratchet rod 24. This function is accomplished by indentations 73, 75 formed in support elements 72, 74, respectively, which indentations individually semi circularly contact the engaged cylindrical segment (such as segment 52*d* illustrated in FIG. 9). Upon locking arms 60, 62 in the closed position by sliding movement of collar 80, as depicted in FIG. 6, opposed lateral movement of the opposed support elements will be inhibited and a gripping force upon cylindrical segment 52*d* will be effected. This gripping force, in combination with the gripping forces exerted by the pair of pawls in the respective ratchet groove provides a multi point support between ratchet rod 24 and adjustment block 20.

Fine adjustment of the distance between opposed first and second arcuate bands 16, 18 is provided by rotating the adjustment block to extend or retract threaded segment 42 of threaded rod 22 with respect to threaded bore 40 in adjustment block 20.

In operation, hat stretcher 10 is first adjusted to the size of headband 14 of hat 12 by drawing collar 80 away from the ends of arms 60, 62 of adjustment block 20. The arms are now free to spring apart in response to springs 72, 73 and release ratchet rod 24. First and second arcuate bands 16, 18 are pulled apart until they reasonably firmly engage hat band 14. Thereafter, arms 60, 62 are brought toward one another with minor translation of the ratchet rod to insure engagement by the pair of pawls with the adjacent ratchet groove and engagement of the support elements with the cylindrical segments. Upon such engagement, collar 80 is translated toward the end of the arms to lock pair of pawls and the pair of support elements in place. It may be noted that ratchet rod 20 is free to rotate with respect to the adjustment block without interference from the pair of pawls or the pair of support elements when collar 80 is in place to prevent opposed lateral displacement of the arms. To effect fine adjustment to stretch the hat band, adjustment block 20 is rotated about its longitudinal axis. Such rotation will produce extension or retraction of threaded rod 20 resulting in commensurate displacement of first arcuate band 16 with respect to second arcuate band 18.

To remove hat stretcher 10 from hat 12, collar 80 is translated away from the ends of arms 60, 62 to permit the arms to spring apart. Thereafter, ratchet rod 24 may be translated longitudinally into the adjustment block to relieve the pressure of the hat stretcher against the headband. The hat stretcher may now be withdrawn from within the hat. To reinstall the hat stretcher, it is placed within the hat in general alignment with headband 14 and ratchet rod is extended from within adjustment block 20 until the pair of pawls engage the formerly engaged ratchet groove. To effect instantaneous engagement upon translation of the ratchet rod, slight manually applied pressure may be placed upon the opposed arms to force the pawls into engagement with the ratchet groove. Thereafter, collar 80 is slid towards the ends of the arms to maintain the pawls in place. Further coarse or fine adjustment of the hat stretcher is unnecessary in order to apply the same amount of "stretch" or force upon headband 14.

It may be noted that the force exerted by headband 14 tending to force the ratchet rod and the threaded rod toward one another is resisted by the radial surfaces defining the respective ratchet grooves engaged by the pair of pawls. These surfaces, being parallel with the pawls, will have no tendency to force the pawls out of the respective ratchet grooves. On the other hand, upon manually drawing the first and second arcuate bands apart, the pawls will readily slide along the cammed surfaces of the respective ratchet grooves engaged and permit the pawls to be repositioned in a next adjacent ratchet groove.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A hat stretcher for engaging the hat band in a hat, said hat stretcher comprising in combination:

a) first and second arcuate bands for engaging opposed sections of the hat band;

b) a threaded rod extending from said first arcuate band;

c) a ratchet rod extending from said second arcuate band, said ratchet rod including a plurality of ratchet grooves and a plurality of sections interleaved by said ratchet grooves;

d) an adjusting block for receiving said threaded rod and said ratchet rod, said adjusting block including a threaded bore for threadedly engaging said threaded rod, said adjusting block further including 1) a pair of opposed pawls for engaging a selected one of said ratchet grooves;

2) a pair of opposed supporting elements for engaging a selected one of said sections;

3) a pair of resilient arms bendable in opposed directions away from said ratchet rod received within said adjusting block, each of said arms supporting in depending relationship one pawl of at least one said pair of pawls and one supporting element of said pair of supporting elements; and 4) a collar axially translatable along said pair of arms from a first position to a second position therealong and return for preventing lateral displacement of said arms and for positioning said pair of pawls and said pair of supporting elements in engagement with said ratchet rod to prevent axial displacement of said ratchet rod relative to said adjusting block when said collar is in the first position and for accommodating lateral displacement of said arms to permit disengagement of said pair of pawls and said pair of supporting elements from said ratchet rod when said collar is in the second position.

2. The hat stretcher as set forth in claim 1 wherein each of said ratchet grooves includes a radially oriented surface engaging said pair of pawls to prevent movement of said second arcuate band toward said first arcuate band and a cammed surface for urging lateral displacement of said pair of pawls upon application of a force upon said second arcuate band to draw said second arcuate band away from said first arcuate band.

3. The hat stretcher as set forth in claim 1 wherein said ratchet rod includes means for interferingly engaging said pair of pawls to preclude axial displacement of said ratchet rod toward said threaded rod without opposed lateral displacement of said pair of arms.

4. The hat stretcher as set forth in claim 3 including an indentation formed in each pawl of said pair of pawls for partly circumscribing said ratchet rod.

5. The hat stretcher as set forth in claim 4 including a further indentation formed in each supporting element of said pair of supporting elements for partly circumscribing the engaged one of said sections.

6. The hat stretcher as set forth in claim 3 including a further indentation formed in each supporting element of said pair of supporting elements for partly circumscribing the engaged one of said sections.

7. The hat stretcher as set forth in claim 1 including spring means for laterally displacing said pair of arms from one another when said collar is in the second position.

8. The hat stretcher as set forth in claim 1 wherein each of said first and second arcuate bands is in contact with substantially half of the headband upon mounting of said hat stretcher within the hat.

9. The hat stretcher as set forth in claim 1 wherein each of said first and second arcuate bands includes a brace for maintaining the curved shape of the respective segment of the headband.

10. A hat stretcher for engaging a hat band in a hat, said hat stretcher comprising in combination:

a) first and second arcuate bands for contacting opposed segments of the hat band;

b) a threaded rod extending from said first arcuate band;

c) a ratchet rod extending from said second arcuate band, said ratchet rod including ratchet grooves and sections interleaving said ratchet grooves;

d) an adjusting block for receiving said threaded rod and said ratchet rod;

e) means for threadedly engaging said threaded rod with said adjusting block to provide fine adjustment for said hat stretcher;

f) means for positionally locking said ratchet rod with said adjusting block to provide coarse adjustment for said hat stretcher, said locking means including a pair of opposed arms each arm of said pair of arms having a free end, each of said arms including a pawl disposed proximate said free end for engaging a selected one of said ratchet grooves and a supporting element displaced from said free end for engaging a selected one of said sections, a collar circumscribing said pair of arms and translatable therealong from a first position preventing lateral displacement of said free ends from one another to maintain said pawls and said supporting elements in engagement with said ratchet groove and said section, respectively, and to a second position accommodating displacement of said free ends from one another to permit disengagement of said pawls and said supporting elements from said ratchet groove and said section, respectively, and return; and g) means for urging said ends away from one another when said collar is in the second position.

11. A method for mounting a hat stretcher within a hat, said method comprising:

a) inserting first and second arcuate bands in opposed relationship adjacent the headband of the hat;

b) coarsely adjusting the hat stretcher by drawing the first and second arcuate bands in opposed directions to contact and bear against the head band;

c) said step of adjusting including the step of translating a ratchet rod associated with one of the first and second arcuate bands to position opposed pawls of a pair of pawls within a ratchet groove of the ratchet rod, which pawls extend toward one another from opposed arms of an adjustment block;

d) urging lateral displacement of the ends of the arms from one another to urge disengagement of the pawls from within the respective ratchet grooves and to accommodate translation of the ratchet rod in a axial direction and relative to the adjustment block upon whether the hat stretcher is being mounted or;

e) locking the opposed pawls within a selected ratchet groove by preventing lateral displacement of the ends of the arms; and sliding a sleeve axially over the arms to press arms onto said ratchet rod;

f) rotating a threaded segment associated with the adjustment block to finely adjust the distance between the first and second arcuate bands and the force exerted upon the hat band.

* * * * *